US007458112B1

(12) United States Patent
Yang

(10) Patent No.: US 7,458,112 B1
(45) Date of Patent: Dec. 2, 2008

(54) SHOWER ASSEMBLY KIT WITH MULTIPLE FUNCTIONS

(76) Inventor: Ue-Ming Yang, 2712 S. Union Ave., Chicago, IL (US) 60616

( * ) Notice: Subject to any disclaimer, the term of this patent is extended or adjusted under 35 U.S.C. 154(b) by 0 days.

(21) Appl. No.: 12/077,918

(22) Filed: Mar. 24, 2008

(51) Int. Cl.
*A47K 3/22* (2006.01)
*A47K 3/28* (2006.01)

(52) U.S. Cl. ..... 4/601; 4/567; 4/570; 137/625.47; 251/309

(58) Field of Classification Search ..... 4/570, 4/567, 569, 601, 615; 137/625.46, 625.47; 251/309–312, 314, 317
See application file for complete search history.

(56) References Cited

U.S. PATENT DOCUMENTS

| | | | | |
|---|---|---|---|---|
| 3,687,416 | A * | 8/1972 | Mueller | 251/309 |
| 4,274,400 | A * | 6/1981 | Baus | 4/615 |
| 5,678,258 | A * | 10/1997 | Healy | 4/601 |
| 6,038,715 | A * | 3/2000 | Flieger et al. | 4/601 |
| 7,219,376 | B1 * | 5/2007 | Zhou | 4/567 |

* cited by examiner

*Primary Examiner*—Tuan N Nguyen

(57) ABSTRACT

A three-way rotary valve is remotely operated by a remote actuator assembly at multiple positions that include diverting flow to: a hand held shower head, an over head fixed shower head, both hand held shower head and over head fixed shower head, and diverting minimum leakage flow to hand held shower head to cause water dripping out of hand held shower head. The body of the remote actuator assembly allows a cross bar and a bracket to retain the hand held shower head at an adjustable height.

9 Claims, 4 Drawing Sheets

FIG.3A
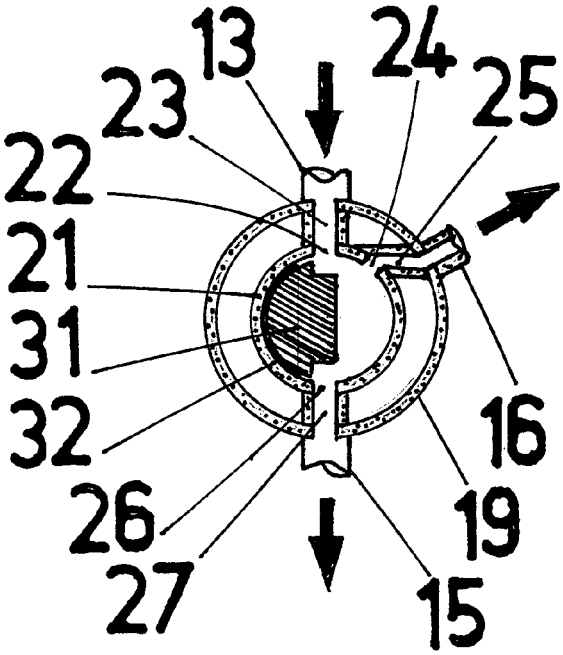
FIG.3D
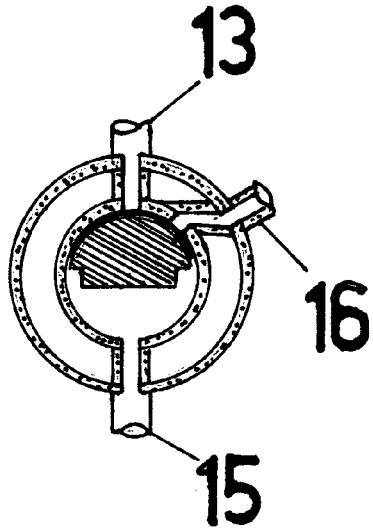
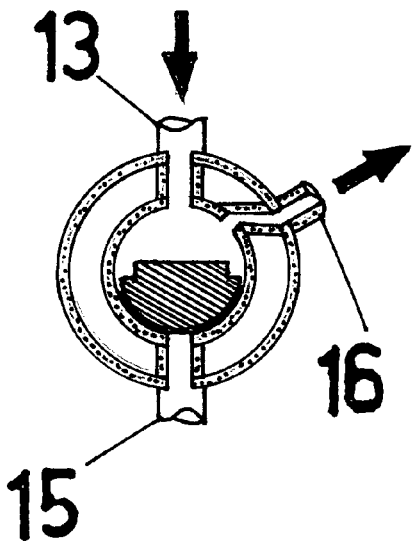
FIG.3B
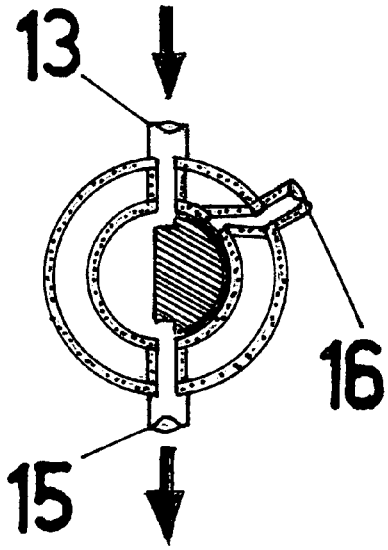
FIG.3C
FIG.3

SHOWER ASSEMBLY KIT WITH MULTIPLE FUNCTIONS

BACKGROUND OF THE INVENTION

This invention relates to a shower assembly kit for improving the quality of taking a shower, and particularly for resolving the following problems commonly encountered during taking shower:

(1). A conventional shower faucet or mixing valve has a single handle for controlling water temperature and turning on/off the valve. Before taking a shower, user needs to repeatedly adjust the handle position and feel the temperature until the right temperature is obtained by trial and error. This is time consuming and wasting water. Also during a shower, user may need to turn off the valve for soaping, and turn on the valve again after soaping. Going through the trial and error routine during a shower is particularly inconvenient. Furthermore, when the valve is turned on after soaping, water temperature must cycle from cold to hot, and thus forces user to be exposed to instant cold water. To avoid such unpleasant exposure to instant cold water, user can only do two things, either run away (if there is extra space in the shower stall), or leave the valve on during soaping (if the water flow can be directed away from user). In the later case, more water and energy are wasted.

One prior approach to the above problems is to install a shut off valve on the over head shower pipe. By turning off the shut off valve in lieu of shower faucet, user can stop water flow during soaping while keep the handle position of shower faucet unchanged. After soaping, user can then turn on the shut off valve and immediately restore the water flow at the same temperature. The drawback of this prior approach is that the shut off valve is located on the over head shower pipe at a relatively high elevation. As a result, the shut off valve can not be easily reached, operated or cleaned. The shut off valve needs to be cleaned due to the fact that, after soaping, user needs to turn on the shut off valve with a soaping hand. There is also a potential problem of turning off the shut off valve to keep the shower faucet on under no flow condition. In such case, an open path is created between the hot water and cold water piping systems.

(2). A hand-held shower massage head has been popular for use during shower. It has not only enhanced quality of taking a shower, but also been useful for cleaning the shower environment after a shower. The hand held shower massage head can also be retained by a bracket for use as a fixed shower head. There has been another popular demand for a moveable bracket so that the height of shower head can be adjusted. One commercial application in response to this demand is to provide a bracket sliding on a vertical bar that is anchored to wall. To anchor bar to wall is not only time consuming, but also causing a permanent damage to wall, particularly if the wall is covered with tiles. There has been another popular demand for a shower assembly equipped with both hand-held shower massage head and an over head fixed shower head. One commercial application in response to the above two popular demands is to provide a shower assembly comprising of four principal parts: a hand-held shower massage head, an over head fixed shower head, a flow diverter, and a vertical bar does not require to be anchored to wall. The hand held shower massage head is retained by a bracket slidable on the vertical bar. The flow diverter diverts water flow to the over head shower head or hand held shower massage head, or both. Since flow diverter is located near the over head shower pipe at a high elevation, it is difficult to be reached and operated.

Up to today, there is no single prior approach solving all the above problems simultaneously. Obviously, there are significant economical and commercial benefits for solving all the above problems simultaneously. The shower assembly kit of present invention is capable of solving all the above problems simultaneously, and overcoming all the drawbacks of prior approaches.

The shower assembly kit of present invention comprises of four principal parts: a hand-held shower massage head, an over head fixed shower head, a three-way rotary valve, and a remote actuator assembly for remotely operating the rotary valve from a distance away from the valve.

One distinctive aspect of present invention is to provide an unique three-way rotary valve with combined functions of a shut off valve and a flow diverter. The new valve has four equally divided operating positions within a 360 degree rotation, in which, flow is diverted flow to the over head fixed shower head, hand held shower massage head, both over head fixed shower head and hand held shower massage head, or stop flow at a shut off position.

Another distinctive aspect of present invention is to allow the three-way rotary valve to divert a minimum leakage flow to the hand held shower head to cause water dripping out of hand held shower head when the valve is operated at shut off position. When an user operates the three-way rotary valve at shut off position in conjunction with a shower faucet at desired temperature position, user can interrupt water flow and avoid shower spray during soaping. The three-way rotary valve does not divert any leakage flow to the over head fixed shower head at shut off position so that no water dripping out of over head fixed shower head during soaping. Water dripping out of hand held shower head, that is not located directly above user, will not cause inconvenience to user during soaping. After soaping, user can immediately restore the desired water flow and temperature as soon as the three-way rotary valve being turned on again. In a remotely possible event that user turns off the rotary valve in lieu of shower faucet after completion of shower, continuous water dripping out of hand held shower head provides a warning signal to remind user to turn off the shower faucet. As previously discussed, it is not desirable to keep the shower faucet on under no flow condition due to the fact that it creates an open path between the hot water and cold water piping systems. From fluid dynamic point of view, the minimum leakage flow diverted to the hand held shower head will prevent any leakage between the hot and cold water piping systems.

Another distinctive aspect of present invention is to provide a remote actuator assembly, which not only allows user to remotely operate the three-way rotary valve at a comfortable elevation, but also facilitates the mobility of the hand held shower massage head along the body of remote actuator assembly.

SUMMARY OF THE INVENTION

One object of present invention is to provide a three-way rotary valve with four equally divided operating positions within a 360 degree rotation that include: a first position to divert flow to hand held shower head, a second position to divert flow to over head fixed shower head, a third position to divert flow to both hand held shower head and over head fixed shower simultaneously, and a fourth position as a shut off position to stop flow.

Another object of present invention is to allow the three-way rotary valve to divert a minimum leakage flow to the hand held shower head to cause water dripping out of hand held shower head when the valve is operated at shut off position.

Another object of present invention is to provide a remote actuator assembly to remotely operate the three-way rotary valve at a comfortable height.

Another object of present invention is to provide the remote actuator assembly that allows the hand held shower massage head's retaining bracket to slide up and down along the body of the remote actuator assembly.

Another object of present invention is to provide attractive appearance of the shower assembly kit of present invention.

BRIEF DESCRIPTION OF THE DRAWINGS

FIG. 3 is a schematic and cross sectional view of the multiple operating positions of the three way rotary valve of present invention.

DETAILED DESCRIPTION OF THE DRAWINGS

Figure 1:
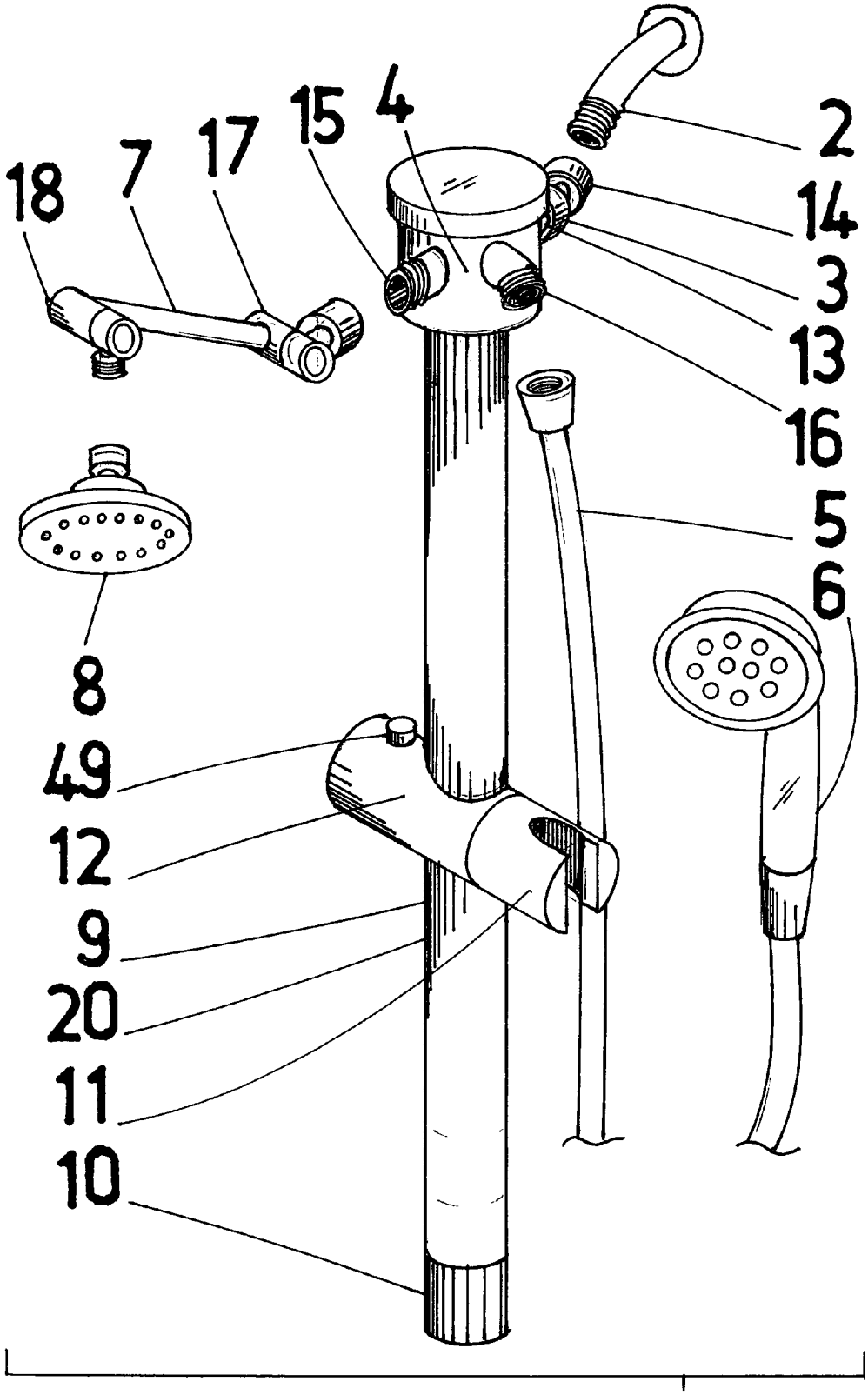
FIG. 1 is a perspective elevation view of the shower assembly kit of present invention.

FIG. 1 is a perspective elevation view of the shower assembly kit of present invention. The shower assembly kit 1 is connected to an existing over head shower pipe 2, which is typically a bend pipe. The shower assembly kit 1 comprises of a rotational pipe connector 3, a three-way rotary valve 4, a flexible hose 5, a hand-held shower head 6, a swing arm 7, an over head fixed shower head 8, a remote actuator assembly 9 with a remote turning knob 10, a bracket 11 attached to a cross bar 12.

The connector 3 is located at the inlet port 13 of rotary valve 4, which is a conventional ball-joint rotational connector with a female inlet end 14 connected to shower pipe 2. Therefore, the remote actuator assembly 9 can be positioned at a relatively vertical position. The outlet port 15 of rotary valve 4 is at 180 degree opposite to inlet port 13 so that the over head fixed shower head 8 can be centrally located in line with shower pipe 2. The use of connector 3 shifts rotary valve 4 further away from shower pipe 2. Therefore, the vertical position of remote actuator assembly 9 may need to be adjusted to a slightly inclined position toward the wall where shower pipe 2 is located. Another outlet port 16 of rotary valve 4 is located as close to inlet port 13 as practical, say 60 degree separation. The outlet port 16 has an inclined sprout for connecting with flexible hose 5 in order to avoid a sharp turn at the inlet end of flexible hose 5. The swing arm 7 is a conventional swing arm with rotational connectors 17 and 18 at both inlet and outlet ends respectively. Therefore, the height of over head fixed shower head 8 is adjustable, and the over head fixed shower head 8 is also adjustable to face downward.

It is understood that, instead of using the ball-joint rotational connector 3 in FIG. 1, the inlet port 13 of rotary valve 4 can be alternatively connected to shower pipe 2 through a rotational connector similar to the rotational connectors 17 and 18. But this will cause the over head fixed shower head to be off-center.

Figure 2A:
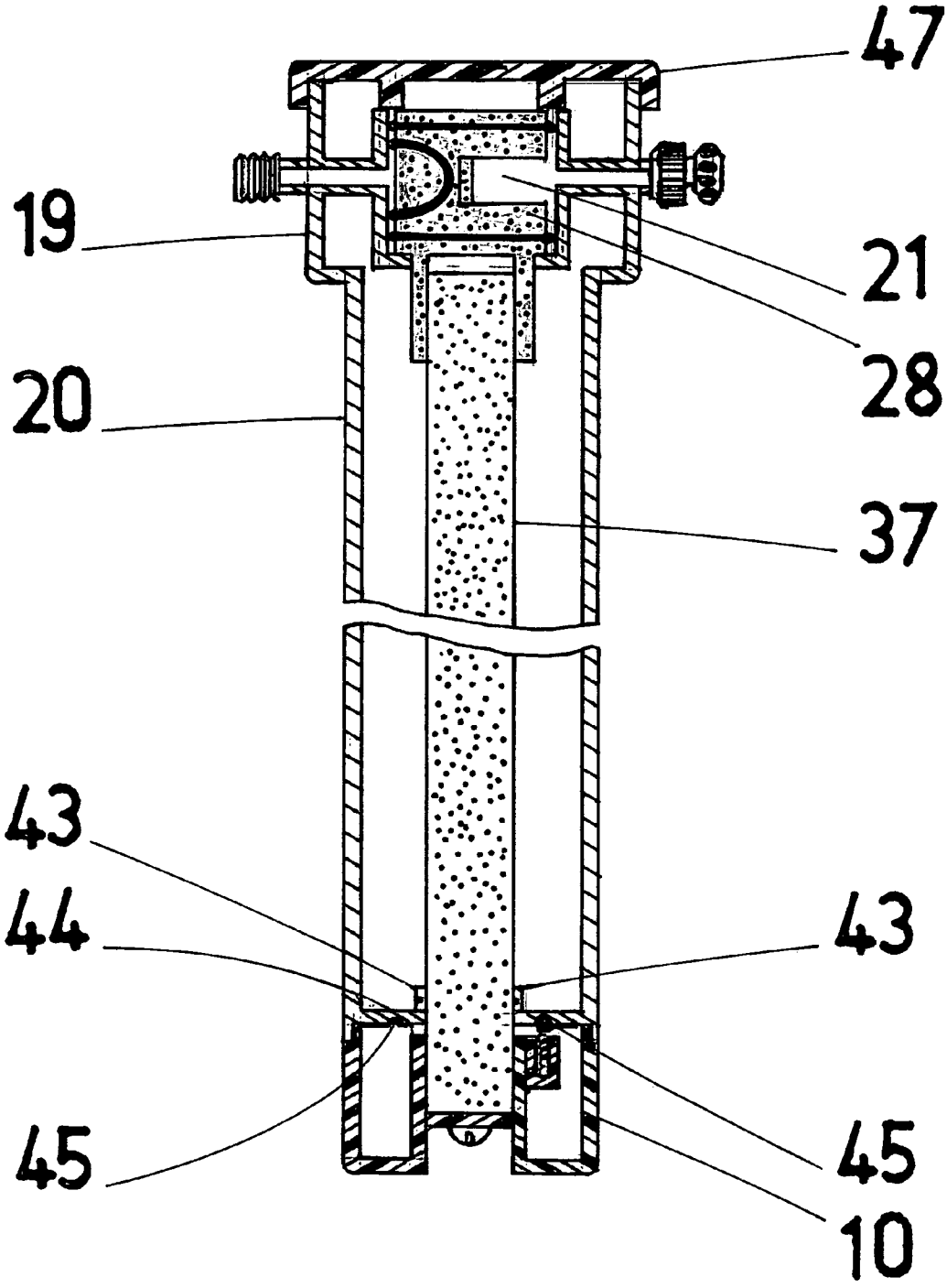
FIG. 2A is a schematic and cross sectional view of the three way rotary valve and the remote actuator assembly of present invention.
Figure 2B:
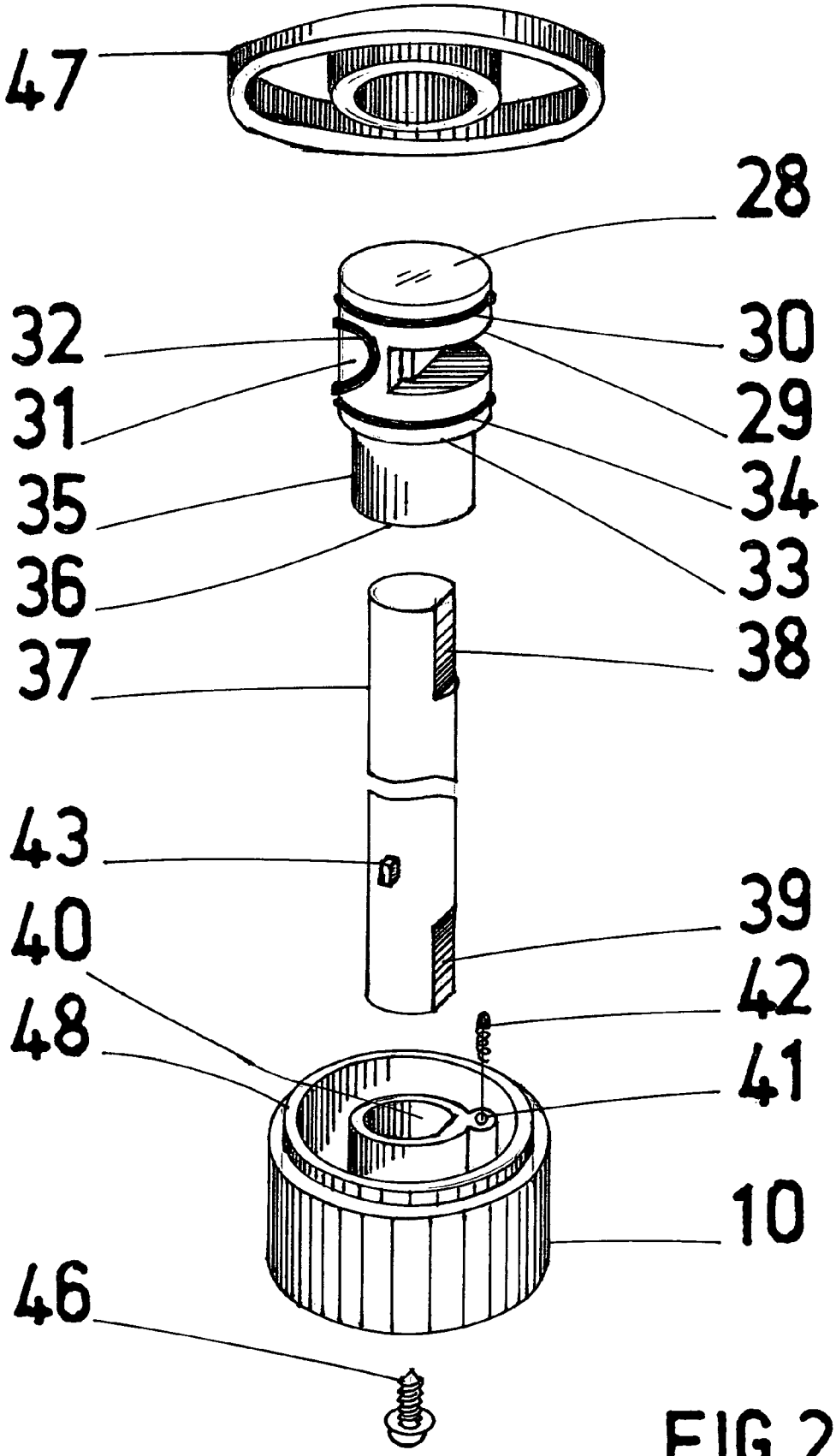
FIG. 2B is an explode view of the internal parts of the three way rotary valve and the remote actuator assembly of present invention.

FIG. 2A is a schematic and cross sectional view of the three way rotary valve 4 and the remote actuator assembly 9 of present invention. FIG. 2B is an explode view of the internal parts of the three way rotary valve 4 and the remote actuator assembly 9 of present invention. It becomes apparent from FIG. 2A that the remote actuator assembly 9 is constructed as an integral part of rotary valve 4. This integral structure has a valve body 19 and an actuator body 20. Within the valve body 19, there is an internal flow chamber 21 fluidly connected to the inlet and outlet ports of rotary valve 4. Their configuration can be easily seen in FIGS. 3A through 3D. In FIG. 3A, flow chamber 21 has an opening 22 and a passage way 23 connected to inlet port 13, an opening 24 and a passage way 25 connected to outlet port 16, and an opening 26 and a passage way 27 connected to outlet port 15. Valve plug 28 is fit nicely within flow chamber 21 with minimum clearance. Plug 28 has a top cylindrical section 29 provided with a lateral groove (not shown) for receiving o-ring 30, an eccentric midsection 31 provided with a peripheral groove (not shown) for receiving o-ring 32, a lower cylindrical section 33 provided with a lateral groove (not shown) for receiving o-ring 34, and a valve stem 35 provided with an eccentric cavity 36 at the bottom. Connecting rod 37 has an eccentric top end 38 for connecting valve stem 35 through eccentric cavity 36, and an eccentric bottom end 39 for connecting turning knob 10 through an eccentric cavity 40 within turning knob 10. Within turning knob 10, a cylindrical cavity 41 is provided for receiving a spring biased plug 42. Projectiles 43 is provided at the lower section of connecting rod 37, which sits on the bearing plate 44 integrally constructed at the bottom of actuator body 20. Multiple detents 45 are provided on the bottom surface of bearing plate 44 for receiving the spring biased plug 42 as turning knob 10 being rotated. These detents provide a feel and clipping sound when turning knob 10 is rotated to the operating positions. Turning knob 10 is fastened to the bottom of connecting rod 37 by a screw 46. The top opening ends of valve section 19 and flow chamber 21 are covered by a thread cap 47. It should be noted that turn knob 10 is jointed to the bottom of actuator body 20 with an off-set joint 48 so that the joint is sealed against water intrusion;

FIGS. 3A through 3D demonstrates the four operating positions of the rotary valve 4. FIG. 3A shows the valve 4 is rotated to a first position, in which, the eccentric midsection 31 diverts flow from inlet port 13 to both outlet ports 15 and 16. FIG. 3A shows the valve 4 is rotated to a first position, in which, the eccentric midsection 31 diverts flow from inlet port 13 to both outlet ports 15 and 16. FIG. 3B shows the valve 4 is rotated to a second position, in which, the eccentric midsection 31 diverts flow from inlet port 13 to outlet port 16. It should be noted that the peripheral o-ring 32 completely envelopes opening 26 to stop leakage to outlet port 15. FIG. 3C shows the valve 4 is rotated to a third position, in which, the eccentric midsection 31 diverts flow from inlet port 13 to outlet port 15. It should be noted that the peripheral o-ring 32 completely envelopes opening 24 to stop leakage to outlet port 16. FIG. 3D shows the valve 4 is rotated to a fourth position, in which, the peripheral o-ring 32 completely envelopes both openings 22 and 24. Therefore, there is only minimum leakage flow diverted from inlet port 13 to outlet port 16. There is no flow, not even a minimum leakage flow, diverted from inlet port 13 to outlet port 15. The above four operating positions are equally separated within a 360 degree rotation. It should be noted that, in order to achieve the fourth operating conditions, opening 24 needs to be located as close to opening 22 as practical. However, the outlet port 16 must be separated from inlet port 13 at a minimum distance (say 60 degree) to avoid interference of pipe fittings. Consequently, passage 25 to outlet port 16 is not extended in a radially outward direction.

It is understood that rotary valve 4 and remote actuator assembly 9 may have a different configuration other than those described above, and still achieve the same object of present invention. Variations and modifications to the rotary valve 4 and remote actuator assembly 9 are allowed within the scope of present invention. Further more, any partial implementation of the described embodiments of present invention, such as using the same technique of the remote actuator assembly 9 for a conventional flow diverter shall also be considered within the scope of present invention.

It should be noted that cross bar 12 is provided with a releasing button 49 in FIG. 1. The releasing button 49 is used to release a locking mechanism (not shown) concealed within the cross bar 12. This locking mechanism is required to secure cross bar 12 in position on the body 20 of remote actuator assembly 9. Upon activating releasing button 49, user can slide cross bar freely. Since the locking and releasing techniques are well known in prior art, it is not the intent of present invention to provide detailed description of these locking and releasing means.

It is also understood that the actuator body 20 allows cross bar 12 to slide up and down for adjusting the height of hand held shower head 6. Adding another cross bar similar to cross bar 12, but with a holder for retaining personal item such as soap or shampoo, shall be considered within the scope of present invention.

What is claimed is:

1. A three-way rotary valve comprises:

an inlet port, a first and second outlet ports; and an internal flow chamber having a first opening fluidly connected to said inlet port through a first passage way, a second opening fluidly connected to said first outlet port through a second passage way, a third opening fluidly connected to said second outlet port through a third passage way; and a plug having an upper cylindrical section, an eccentric midsection, and a lower cylindrical section, in which, the outer surface of said upper cylindrical section is provided with a lateral groove for receiving a first o-ring, the outer surface of said lower cylindrical section is provided with another lateral groove for receiving a second o-ring, and the outer surface of said eccentric midsection is provided with a peripheral groove for receiving a third o-ring;

wherein:

said plug being rotated within said flow chamber to a first position so that said eccentric midsection diverts flow from said inlet port to both said first and second outlet ports; and said plug being rotated within said flow chamber to a second position so that said eccentric midsection diverts flow from said inlet port to said first outlet port, and said third o-ring completely envelopes said third opening to stop leakage flow to said second outlet port; and said plug being rotated within said flow chamber to a third position so that said eccentric midsection diverts flow from said inlet port to said second outlet port, and said third o-ring completely envelopes said second opening to stop leakage flow to said first outlet port; and said plug being rotated within said flow chamber to a fourth position so that said third o-ring completely envelopes both said first and second openings, therefore, there is only a leakage flow diverted from said inlet port only to said first outlet port, and there is no flow, not even a minimum leakage flow, diverted to said second outlet port; and said first, second, third and fourth positions are equally separated within a 360 degree rotation.

2. A shower assembly kit comprises:

a three-way rotary valve having an inlet port, a first and second outlet ports; and a flexible hose having an inlet and outlet ends, and said inlet end being fixedly connected to said first outlet port of said rotary valve; and a hand-held shower head being fixedly connected to said outlet end of said flexible hose; and a swing arm having an inlet end and outlet ends, and said inlet end being rotationally connected to said second outlet port of said rotary valve so that said swing arm can rotate vertically to adjust the height of said outlet end of said swing arm; and a over head fixed shower head being rotationally connected to said outlet end of said swing arm so that said over head fixed head can rotate to face downward; and a remote actuator assembly connected to said rotary valve so that said rotary valve can be remotely operated at distance away from said rotary valve; and a cross bar being slidably connected to the outer surface of a body of said remote actuator assembly so that said cross bar can be adjusted to a various height; and a bracket being attached to said cross bar for retaining said hand-held shower head;

wherein:

said rotary valve capable of being remotely operated at three positions, in which, a first position is to divert flow to said hand held shower head through said first outlet port of said rotary valve, a second position is to divert flow to said over head fixed shower head through said second outlet port of said rotary valve, and a third position is to divert flow to both said over head fixed shower head and said hand held shower head through both said first and second outlet ports.

3. A shower assembly kit comprises:

a three-way rotary valve having an inlet port, a first and second outlet ports; and a flexible hose having an inlet and outlet ends, and said inlet end being fixedly connected to said first outlet port of said rotary valve; and a hand-held shower head being fixedly connected to said outlet end of said flexible hose; and a swing arm having an inlet end and outlet ends, and said inlet end being rotationally connected to said second outlet port of aid rotary valve so that said swing arm can rotate vertically to adjust the height of said outlet end of said swing arm; and a over head fixed shower head being rotationally connected to said outlet end of said swing arm so that said over head fixed head can rotate to face downward; and a remote actuator assembly connected to said rotary valve so that said rotary valve can be remotely operated at distance away from said rotary valve; and a cross bar being slidably connected to the outer surface of a body of said remote actuator assembly so that said cross bar can be adjusted to a various height; and a bracket being attached to said cross bar for retaining said hand-held shower head;

wherein:

said rotary valve capable of being remotely operated at four equally separated positions within a 360 degree rotation, in which, a first position is to divert flow to said hand held shower head through said first outlet port of said rotary valve, a second position is to divert flow to said over head fixed shower head through said second outlet port of said rotary valve, a third position is to divert flow to said over head fixed shower head and said hand held shower head through said first and second outlet ports respectively, and a fourth position is to divert a minimum leakage flow to said hand held shower head through said first outlet port, but divert no flow, not even a minimum leakage flow, to said over head fixed shower head through said second outlet port.

4. The shower assembly kit of claim 2 or 3, wherein said shower assembly kit is provided with a 90 degree elbow with an inlet and outlet ends, in which, said inlet end of said elbow is fixedly connected to a shower pipe with a swivel connector so that said outlet end is positioned at a horizontal position, and said outlet end of said elbow is fixedly connected to said inlet port of said rotary valve with a swivel connector so that the body of said remote actuator assembly is positioned at a relatively vertical position.

5. The shower assembly kit of claim 2 or 3, wherein said shower assembly kit is provided with a ball-joint rotational connector with an inlet and outlet ends, in which, said inlet end of said connector is fixedly connected to a shower pipe, and said outlet end of said connector is fixedly connected to said inlet port of said rotary valve with a swivel connector so that the body of said remote actuator assembly is positioned at a relatively vertical position.

6. The shower assembly kit of claim 2 or 3, wherein said remote actuator assembly is provided with a turning knob for remotely operating said rotary valve at all operating positions with detents.

7. The shower assembly kit of claim 2 or 3, wherein said cross bar is provided with a locking means for securing said cross bar in position on the body of said remote actuator assembly, and a releasing means for unlocking said locking means so that said cross bar is capable of sliding on the body of said remote actuator assembly upon activating said releasing means.

8. The shower assembly kit of claim 2 or 3 further comprises there is a means of rotationally attaching said bracket to said cross bar for retaining said handheld shower head.

9. The shower assembly kit of claim 2 or 3, wherein said shower assembly kit is provided with a second cross bar slidable on the body of said remote actuator assembly, and a holder fixedly attached to said second cross bar for retaining a personal item; and said second cross bar is provided with a locking means for securing said second cross bar in position on the body of said remote actuator assembly, and a releasing means for unlocking said locking means so that said second cross bar is capable of sliding on the body of said remote actuator assembly upon activating said releasing means.

* * * * *